United States Patent [19]

Howard

[11] 4,410,775

[45] Oct. 18, 1983

[54] SNAP-ACTION BATTERY CABLE SWITCH

[76] Inventor: Durrell U. Howard, 306 Krameria Dr., San Antonio, Tex. 78213

[21] Appl. No.: 310,698

[22] Filed: Oct. 13, 1981

Related U.S. Application Data

[63] Continuation-in-part of Ser. No. 66,971, Aug. 16, 1979, Pat. No. 4,306,126.

[51] Int. Cl.[3] ..... H01H 5/00

[52] U.S. Cl. ..... 200/52 R; 200/16 A; 200/76; 200/302; 307/10 AT; 307/10 BP

[58] Field of Search ..... 200/52 R; 307/10 AT, 307/10 BP; 200/153 F, 64, 284, 302, 156, 76, 153 V, 4, 16 A, 243, 248-251

[56] References Cited

U.S. PATENT DOCUMENTS

| | | | |
|---|---|---|---|
| 1,902,765 | 3/1933 | Deitsch | 307/10 BP |
| 2,538,581 | 1/1951 | Minch et al. | 307/10 BP |
| 2,539,628 | 1/1951 | Kingdon | 200/284 |
| 3,888,560 | 6/1975 | Smith et al. | 200/284 |

FOREIGN PATENT DOCUMENTS 782174 9/1957 United Kingdom .

*Primary Examiner*—A. T. Grimley
*Assistant Examiner*—Morris Ginsburg
*Attorney, Agent, or Firm*—Pollock, Vande Sande & Priddy

[57] ABSTRACT

Disclosed is a switch for selectively connecting an electrical system to a source of electrical power, such as a battery. At least two electrically conductive bodies are mounted within a switch housing in spaced relation to each other and in communication with a housing chamber. Fastening means are provided for connecting each conductive body to an electrical cable. An electrically conductive contactor carried within the chamber is movable between a closed position in contact with each conductive body and an open position out of contact with each conductive body. A first biasing means presses the contactor into engagement with the conductive bodies in response to movement of an actuator means toward a first position and a second biasing means snaps the contactor out of contact with the conductive bodies in response to movement of the actuator means toward a second position, actuator movement being responsive to a mechanical or electrical signal produced remotely from the switch housing. The first and second biasing means may comprise first and second spring members, respectively, with the spring constant of the first member being substantially greater than the spring constant of the second member and the effective length of the first member being substantially less than the effective length of the second member.

14 Claims, 6 Drawing Figures

FIG. 3
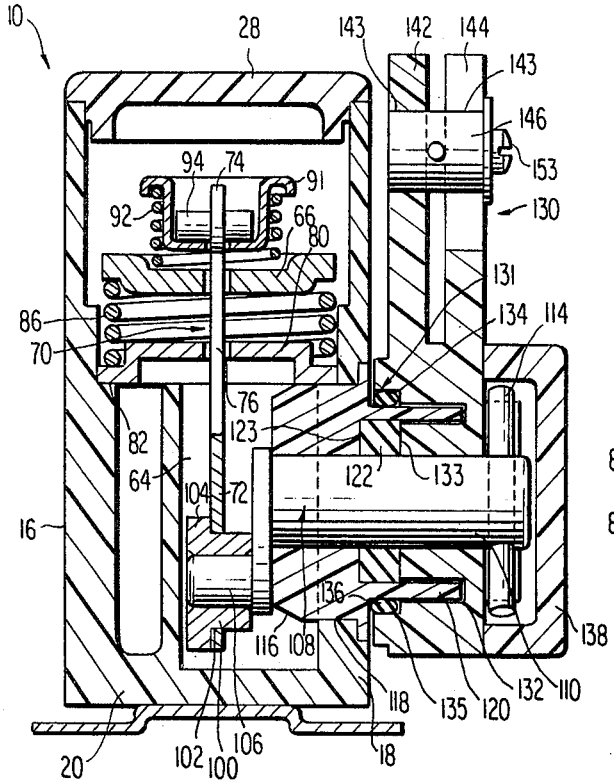
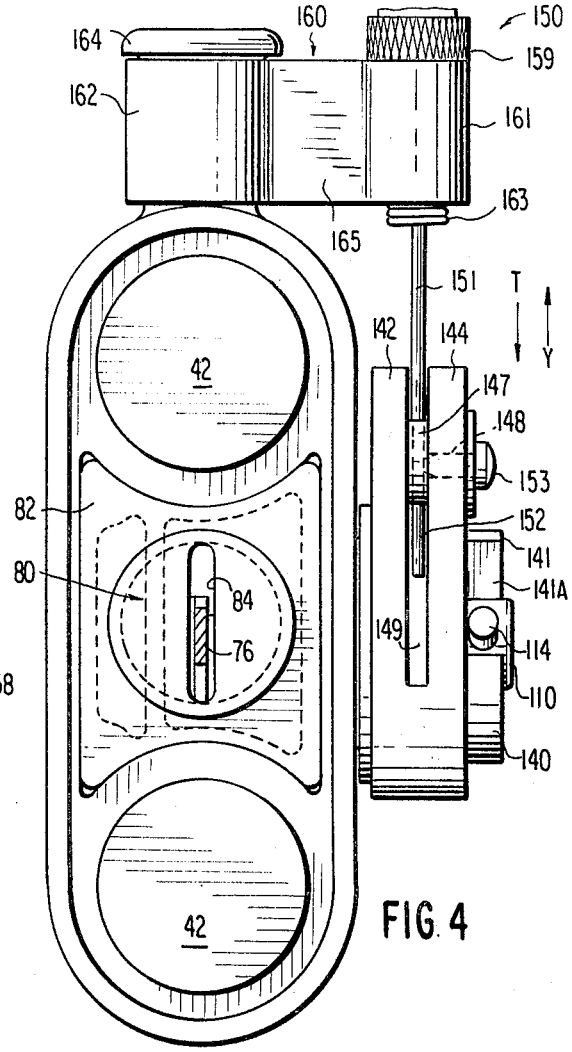
FIG. 4
FIG. 6
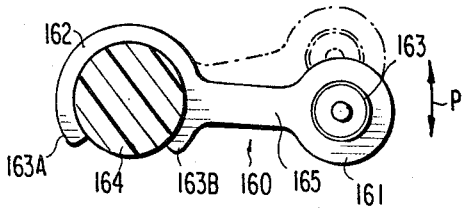
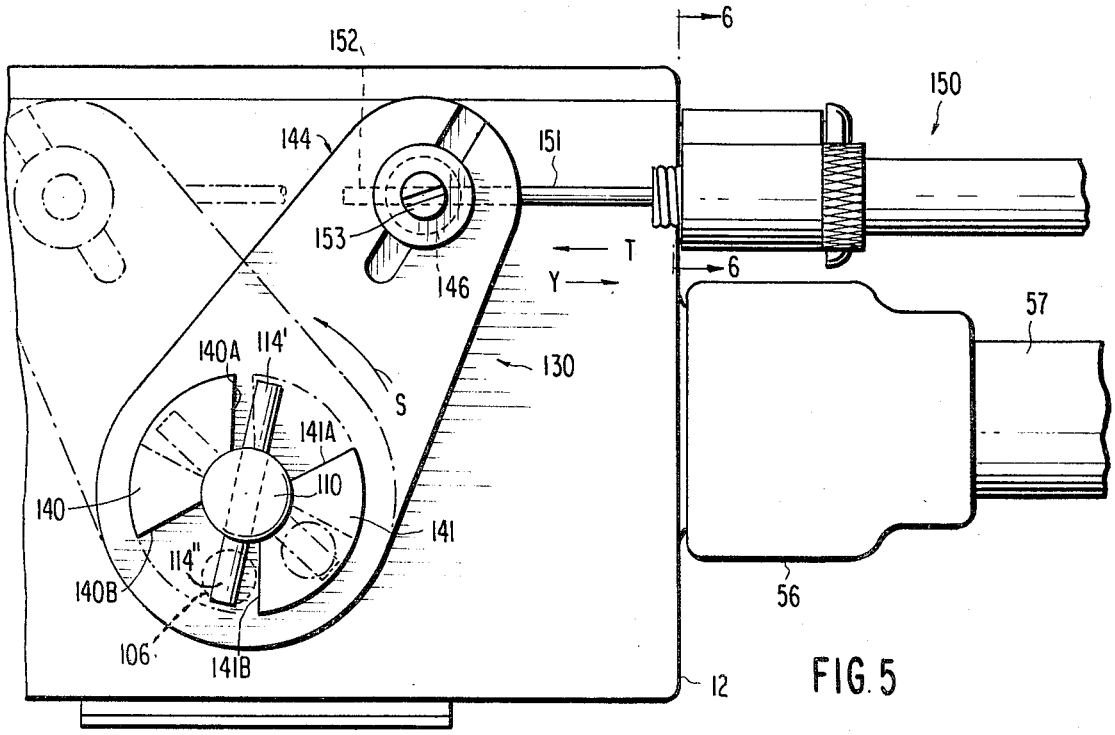
FIG. 5

SNAP-ACTION BATTERY CABLE SWITCH

RELATED APPLICATION

The present application is a continuation-in-part of co-pending application Ser. No. 066,971, filed Aug. 16, 1979, now U.S. Pat. No. 4,306,126 issued Dec. 15, 1981, in the name of Durrell U. Howard, who is also the inventor of the present application. The subject matter of said co-pending application Ser. No. 066,971 is hereby incorporated into the present application by reference.

TECHNICAL FIELD

This invention relates to electrical switches, and more particularly to switches for interrupting the electrical connection between heavy cables for carrying relatively high current loads. The invention is especially useful as a disconnect switch for vehicle battery cables.

BACKGROUND OF THE INVENTION

There are a number of switch devices in the prior art adapted to be interposed between the storage battery and the electrical system of an automobile. The purpose of these devices is to provide a means for interrupting or breaking the electrical circuit so as to isolate the battery. This promotes safety and helps avoid fires by preventing accidental starting and eliminating short circuits. Also, the components of the electrical system can be worked on without fear of causing a short circuit that could damage component parts due to the high current loads available from the battery. Such switch devices also find utility in preventing depletion of the battery from small leaks to ground in the electrical system, as are often present in older vehicles of the classic or antique type, and as theft prevention devices.

The prior art includes breaker type switches wherein a removable breaker element is manually inserted and removed from between two contact members to make and break the electrical circuit, respectively. Two such devices are shown in the patents to Dunn et al, U.S. Pat. No. 2,801,399, and to Salters, No. 4,092,506. These breaker type switches are operable only at the switch juncture.

Remotely operated battery switches are shown in the U.S. Pat. Nos. to Minch et al, No. 2,538,581 and Karl, No. 2,853,627, as well as the French patent to Palau, No. 814,033. A chief drawback of each of these switch assemblies is a tendency for electrical current to arc between a movable contact and at least one stationary contact during switch disengagement. Such a problem is effectively eliminated by the snap action disengagement in the present invention. The safety switch in Karl also suggests a push-pull contact assembly having no mechanical advantage to reduce the contact engagement pressure of the biasing spring member. Regarding Palau, only one electrical contact is employed, whereas double contacts are preferred in order to insure positive interruption of the electrical circuit when the switch is open, especially since foreign materials can build up between contact surfaces. The contact element of Palau is also subject to frequent flexure which causes stress fatigue and can result in rapid failure.

Such prior art devices have a number of other significant disadvantages. Contact surfaces and other internal parts are exposed to moisture and other corrosive materials. Because many known switches are often mounted directly upon the battery terminal, they are subject to the corrosive action of battery fluids and terminal deposits.

DISCLOSURE OF THE INVENTION

The electrical switch of the present invention has a number of advantages over heavy cable switches of the prior art. The switch is designed especially for simple and efficient installation at a location intermediate to the ends of an existing battery cable rather than for attachment directly to a battery terminal. The switch preferably comprises a housing molded of high temperature plastic capable of withstanding temperatures of at least 400° F. A pair of conductive bodies are preferably molded into their respective positions within the housing to provide a fluid tight seal within the switch housing which prevents moisture and/or explosive gases from reaching the electrical contacts.

In the present application, a conventional battery cable is cut at the point of switch insertion and each cut end conductively secured to a corresponding conductive body. A reciprocating contactor element within the housing makes and breaks an electrically conductive path between the two conductive bodies. In its closed position, the reciprocating contactor is biased against both conductive bodies to close the conductive path. In its open position, the contactor is lifted and held off both conductive bodies by large air gaps to ensure a fully open conductive path. Movement of the contactor from its closed position to its open position is produced by a snap action movement of sufficient speed to avoid arcing between the contact surfaces. A connecting rod is preferably mounted within a chamber formed in the switch housing, with a sidewall of the chamber forming a stop for limiting movement of the connecting rod in a given direction corresponding to a preselected rotation of a crankshaft attached to the connecting rod. The crankshaft, connecting rod and conductive bodies are arranged to insure that the contactor engages the conductive bodies when the connecting rod reaches the stop position abutting the chamber sidewall. When the contactor is in the closed position, a relatively hard, spring-like engagement biasing member is compressed between a surface of the contactor and a cup-shaped retainer mounted on an end portion of the connecting rod remotely spaced from the crankshaft. A separate, relatively soft spring-like release biasing member is compressed between a further, oppositely disposed surface of the contactor and a support member arranged within the switch housing. The two biasing members are carefully constructed such that the relatively hard engagement biasing member can achieve an uncompressed shape while the relatively soft release biasing member may remain at least partially compressed at all times. The connecting rod is arranged to pass through an under center position of the crankshaft so as to release the pressure of the cup-shaped retainer against the engagement biasing member. This, in turn, allows the release biasing member to snap the contactor out of electrical engagement with the conductive bodies with sufficient speed to prevent arcing. The arrangement of the crankshaft, connecting rod and biasing members is such that a crankshaft rotation or swing of 5° or less is sufficient to move the connecting rod from the stop position through the under center position and thereby allow the disengagement biasing member to snap the contactor to its open or disengaged position.

Each conductive body in the switch housing has a relatively large contact area which is engaged by a somewhat smaller contact surface on the underside of the contactor when the latter is in its closed position. This feature increases contact pressure and prevents a significant current resistance, even if contact surfaces become worn or fouled by oxides or other foreign materials. Since the switch is mounted away from the battery terminals and effectively moisture-sealed, its connections and components are less likely to become fouled with corrosive-type contaminants. In its open position, the contactor is spaced from both conductive bodies by a substantial distance, preferably at least 3/16" across. This creates two large air gaps to ensure an open electrical circuit. The stroke of the contactor is sufficient to allow the dual contacts to be broken even if foreign material were allowed to accumulate on contact surfaces. This ensures that the switch can be readily opened throughout its useful life.

The snap-action release feature of the present invention eliminates undesirable arcing of electrical current. This, in turn, allows the switch to accomodate currents of 900 A or more at voltages of at least 24 volts. The high electrical capacity and yet compact design of the switch makes the assembly ideal for use in circuits requiring a gang of interconnected switches.

The switch housing comprises a special water-tight enclosure. All of the switch components, except a portion of the actuator, are preferably carried within the housing enclosure. Receptacles for each end of the battery cable are surrounded by a nipple having a rubber boot overlapping the cable. The housing penetration for the crankshaft actuator is also surrounded by a transition structure that sealingly engages both the switch housing and the outer surface of the crankshaft or associated support structure. Ports for cable securing screws are sealed by elastomer plugs held in position by a bracket which abuts at least a portion of the lower housing adjacent to each plug. A moisture tight, compact switch assembly is created which is adaptable for use in automobiles, boats or even airplanes. Furthermore, because the interior portion of the housing is sealed, the switch can be employed in an explosive atmosphere without the risk of detonation.

Although the switch can be supported by the battery cable alone, the switch bracket may be optionally mounted anywhere on a vehicle frame or other structure. Conventional screw fastners are employed for attaching the bracket to both the switch housing and the vehicle. Both battery cable ends are readily detachable so that the switch may be disengaged from all mounted components for maintenance or replacement as desired.

BRIEF DESCRIPTION OF THE DRAWINGS

Other important objects and advantages of the invention will be apparent from the following description and the accompanying drawings in which:

FIG. 3 is a sectional view of the invention taken along lines 3—3 of FIG. 1.

FIG. 4 is a top view of the invention with the switch housing top and certain other elements removed, and the connecting rod shown in section.

FIG. 5 is a side elevational view of a portion of the invention, showing the actuator assembly in closed and open positions.

FIG. 6 is a sectional view of the cable support clip taken along lines 6—6 in FIG. 5.

BEST MODE FOR CARRYING OUT THE INVENTION

Figure 1:
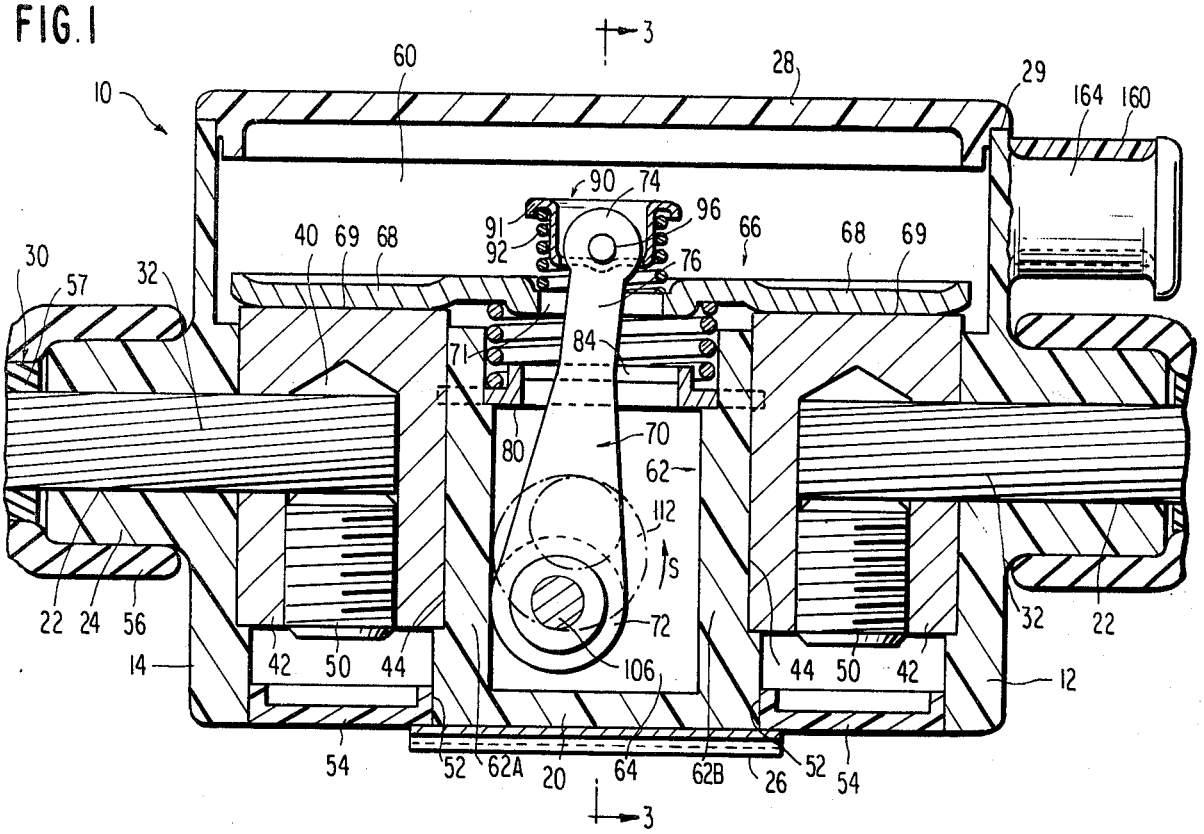
FIG. 1 is a side elevational view of the present invention showing the switch in the closed position.

A preferred embodiment of the invention is illustrated in FIGS. 1 to 6 of the drawings. As best seen in FIGS. 1 and 3, the switch includes a housing 10 having opposing end walls 12 and 14 and opposing side walls 16 and 18. The housing 10 is of electrically insulating material, preferably molded plastic. The end and side walls are integrally attached to a bottom housing wall 20 extending substantially perpendicular to the end and side walls. Each end wall has a cable aperture 22 surrounded by a nipple 24. The switch housing 10 is mounted upon any convenient support structure desired, such as an automobile frame, by means of a mounting bracket 26, which may be secured to the support structure by passing two or more mounting screws through a set of counterbored holes (not shown) in the base of the bracket. The bracket 26 is, in turn, fixedly attached to the bottom housing wall 20 by any conventional fastening means such as screws or by direct molding into housing 10. Mounting bracket 26 is preferably of a resilient spring-like material, capable of at least partially absorbing vibrational shocks which may occur during operation of the automobile, boat, plane or similar structure which supports the switch assembly.

Figure 2:
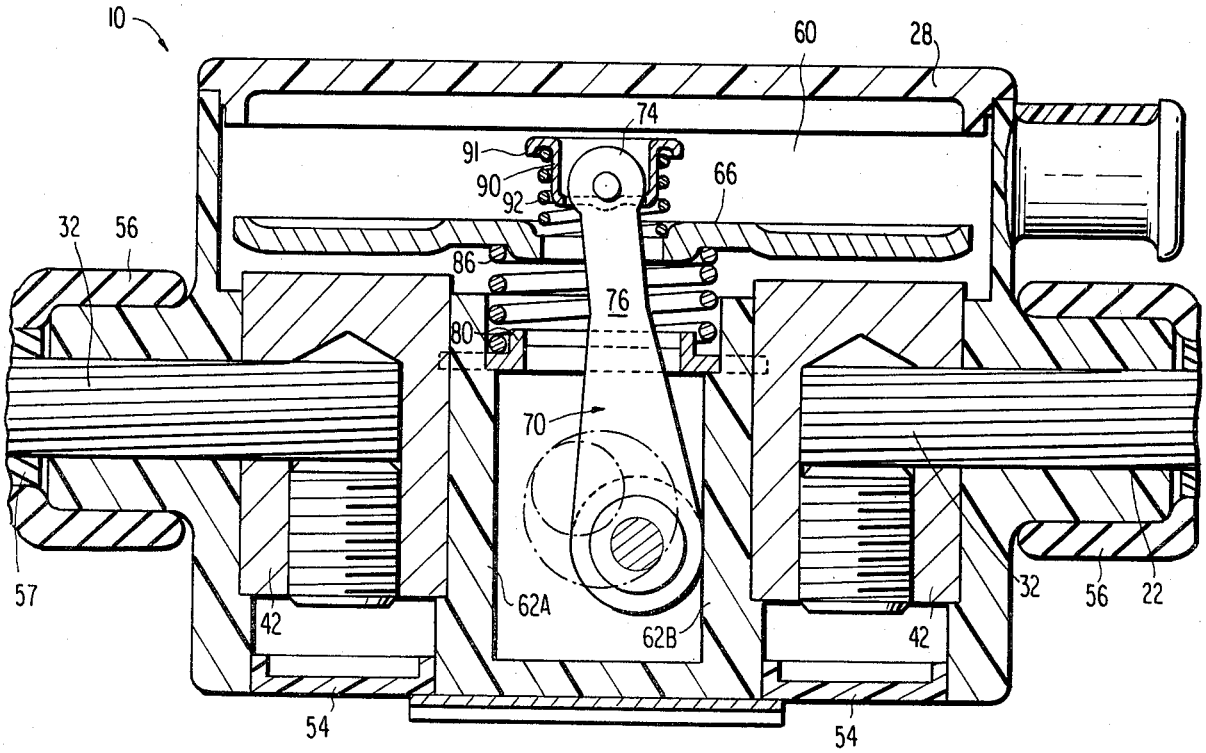
FIG. 2 is a side elevational view of the invention, showing the switch in the open position.

With reference to FIGS. 1 and 2, one end of the battery cable segment 30 passes through one of the cable apertures 22—22. The entire segment 30 may be stripped as shown or, only an end portion 32 of the cable may be stripped. End portion 32 is received within a receptacle 40 in a conductive insert or body 42 located adjacent to aperture 22. The conductive bodies 42—42 are spaced longitudinally apart and are preferably molded in place within cavities 44—44. By molding the conductive bodies into housing 10, a fluid-tight seal is achieved between each conductive body and its corresponding cavity. This ensures that no gas or moisture can leak into a housing cavity 60 from apertures 22—22. As an alternative, the conductive bodies can be press fitted into position in their respective cavities.

The conductive inserts 42—42 are preferably of copper and each includes a set screw 50 for securely clamping the stripped end 32 of the battery cable within the insert. Set screw 50 preferably has a socket (not shown) for receiving an Allen-type wrench, although it is to be understood that other types of set screws may be used. Side wall apertures 52 provide access to the set screws for tightening or loosening the same. The apertures are preferably filled by watertight plugs 54 of elastomer material, such as rubber. These plugs seal the apertures and are locked in place when bracket 26 is attached to housing 10. A rubber boot 56 engages the insulating covering or sheath 57 of the cable and has an end portion pressing tightly against nipple 24 to prevent dirt and moisture from entering housing 10 via aperture 22.

Each of the end walls 12 and 14 as well as side walls 16 and 18 extends an appreciable distance beyond inserts 42—42 as best shown in FIGS. 1 and 2. An upper housing section includes a cover 28 having an outer lip 29 shaped to simultaneously abut end surface portions of each end and side wall, respectively. Housing section 28 is preferably ultrasonically welded into engagement with each end and side wall along abutting surfaces which may become indistinct as the plastic melts and the sections meld together.

The interior chamber or bore 60 is formed between housing cover 28, the upper portions of the end and side walls and each of the inserts 42. Housing assembly 10 further includes dividing wall assembly 62 extending from bottom wall 20 and having opposite sides abutting inserts 42—42. Dividing wall assembly 62 includes spaced portions 62A and 62B forming a central pocket 64 opening into chamber 60. An elongated contactor 66 is positioned within chamber 60 for movement relative to inserts 42 for reasons which will become apparent. Contactor 66 is formed of a metallic material such as copper and includes a pair of depressed end portions 68—68 having flat surfaces 69—69 confronting end surfaces of conductive bodies 42—42. In order to ensure sufficient contact pressure between end portions 68—68 and conductive bodies 42—42, each flat surface 69—69 has a cross-sectional area which is significantly less than the cross-sectional area of the conductive surface confronting the contactor. This concentrates the contact pressure provided by spring 92 over a relatively small area, thereby enhancing the effective pressure between the contacting surfaces. Contactor 66 also includes a slot 71 extending through a centrally disposed portion thereof. In FIG. 1, contactor 66 is shown when switch is in its closed condition. It is apparent that contactor 66 engages each of the inserts 42 to form an electrical connection between the battery cable segments 30 attached thereto. In FIG. 2, contactor 66 is displaced an appreciable distance from each insert 42, corresponding to the open condition of the switch assembly. The preferred means for altering the position of contactor 66 will now be discussed in detail.

A substantially tear-drop shaped connecting rod 70 is located within central pocket 64 as shown in FIGS. 1 and 3. Connecting rod 70 includes an enlarged end 72 of semi-circular configuration and a smaller end 74 also preferably of semi-circular configuration. An elongated intermediate portion 76 extends between and integrally joins each of the end portions. Connecting rod 70 is located such that end portion 72 is adjacent to bottom wall 20, while end portion 74 is located within chamber 60.

Intermediate portion 76 extends through slot 71 formed in contactor 66. As shown in FIGS. 3 and 4, a plate-like support member 80 spans pocket 64 and rests on a lip 82 formed on wall portions 62A and 62B as well as side walls 16 and 18. Support member 80 is formed with a slot 84 of sufficient size to allow intermediate portion 76 of connecting rod 70 to reciprocate therethrough. Support member 80 provides a fixed support for a release biasing spring means 86 compressed between support member 80 and the confronting side of contactor 66. Release biasing spring means 86 preferably comprises a relatively soft coil spring adaptable for separating contactor 66 from inserts 42—42 with a rapid "snap-action" movement.

As shown best in FIGS. 1 and 3, a cup-shaped spring retainer 90 surrounds end portion 74 of connecting rod 70 and includes an outer lip 91 which serves to support a further, engagement biasing spring means 92 extending between retainer 90 and the side of contactor 66 opposite to that abutted by release biasing spring means 86. Engagement biasing spring means 92 also preferably comprises a coil-shaped spring having a significantly higher spring constant as compared to the spring constant of release biasing spring 86. A rod pin 94 extends through an opening 96 in end portion 74 located within an interior bottom portion of retainer 90. Pin 94 holds retainer 90 on end 74 of connecting rod 70 and opposes the biasing forces of springs 86 and 92, while the cup portion of retainer 90 holds pin 94 locked within opening 96 of rod 70. Spring means 86 and 92 are carefully constructed such that engagement spring means 92 can achieve a substantially uncompressed shape while release spring means 86 is still at least partially compressed. By removing the pressure of cup-shaped retainer 90 against engagement spring 92, release spring 86 is allowed to expand and snap contactor 66 out of engagement with conductive bodies 42—42. In order to remove the pressure of cup-shaped retainer 90, connecting rod 70 and attached retainer 90 are arranged to move in the general direction of cover member 28. As such movement occurs, relatively hard engagement spring means 92 expands to its substantially uncompressed shape. This allows release spring means 86 to expand and snap contactor 66 away from the conductive bodies 42—42. When contactor 66 is in the open position, the relatively small amount of compressive force provided by spring 86 does not significantly alter the free-standing, uncompressed shape of spring 92.

The following portion of the description will define an actuator assembly capable of selectively reciprocating connecting rod 70 toward and away from cover member 28 along an axis of movement extending substantially along the axis of coil springs 86 and 92 in the direction of the spring force and substantially perpendicular to the longitudinal axis of contactor 66.

As shown in FIG. 3, a connecting rod bushing 100 projects through an opening 102 formed in the enlarged end 72 of connecting rod 70. Bushing 100 includes a boss 104 extending radially outwardly from an end located adjacent to one side of connecting rod 70. Boss 104 serves to prevent connecting rod 70 from sliding off bushing 100 in the direction of side wall 16. Bushing 100 surrounds and rotatably engages a knob-shaped end portion 106 of a crankshaft 108 as best seen in FIG. 3. Crankshaft 108 includes a main shaft 110 attached at its inner end to one side of a disk-shaped arm 112 having the knob-shaped end portion 106 extending outwardly from its opposite side at an off-center position spaced radially from the longitudinal axis of main shaft 110. Finally, a crankshaft pin 114 extends through an aperture in the outer end of main shaft 110. Pin 114 preferably extends substantially perpendicular to the longitudinal axis of main shaft 110 and projects beyond opposite sides of the main shaft.

Crankshaft 108 is supported in a hollow crankshaft bushing 116 mounted in an opening 118 in side wall 18. After assembly, bushing 116 and cover 28 are ultrasonically welded in place so as to form part of the housing. Bushing 116 includes a cylindrically-shaped sleeve 120 which projects toward pin 114 and is spaced from main shaft 110. An annular sealing member 122 is compressed between sleeve 120 and shaft 110 to provide a fluid-tight seal around shaft 110. Sealing member 122 may be formed of any resiliently deformable material; however, member 122 is preferably formed of an elastomer material such as synthetic rubber. For example, sealing member 122 may be formed of neoprene.

An actuator handle 130 is rotatably mounted on main shaft 110 adjacent to pin 114. Actuator handle 130 includes an annular groove 132 of sufficient size to receive bushing sleeve 120 therein. When handle 130 is mounted on main shaft 110, an annular ridge 133 of handle 130 compresses sealing member 122 toward its seat 123 within bushing 116. Handle 130 also includes a counterbore 131 forming an annular lip 134 around the outer wall of groove 132. Lip 134 confronts a radially extending outer surface of bushing 116 which cooperates with counterbore 131 and sleeve 120 to form an annular chamber 135 containing a resiliently deformable sealing member 136. Sealing member 136 preferably comprises an O-ring of elastomeric material having a diameter larger than the radial width of chamber 135. As a result, O-ring 136 is compressed to form a further seal which in conjunction with seal member 122 prevents fluids, such as moisture vapor or an explosive gas, from entering the housing by leaking around the crankshaft 108. Handle 130 further includes a cap-shaped end member 138 completely surrounding the outer end of crankshaft 108 so as to hold pin 114 in place.

A pair of substantially wedge or pie-shaped stops 140 and 141 extend outwardly from the outer surface of handle 130 and engage the inside of cap member 138 to secure it in place. Each of the wedge-shaped stops 140 and 141 intersects an angular path of movement by pin 114. As shown in FIG. 5, each of the stops is angularly spaced from the other by about 45° to 60° of arc, with a portion of pin 114 extending into the two arcuate spaces defined by opposing surfaces of the stops. The precise spacing between stops 140 and 141 depends on the desired throw of connecting rod 70. Wedgeshaped stop 140 includes a pair of substantially radially extending surfaces 140A and 140B, respectively. Similarly, wedge-shaped stop 141 also includes a pair of substantially radially extending surfaces 141A and 141B. Surfaces 140A and 141A confront opposite sides of a portion 114' of pin 114. Likewise surfaces 140B and 141B confront one another on opposite sides of a further portion 114" of pin 114, with pin portions 114' and 114" extending in opposite directions from one another. As handle 130 is rotated in either a clockwise or counterclockwise direction, each of the projecting stops 140 and 141 is brought into surface contact with pin 114. For example, rotation of handle 130 in a counterclockwise direction as indicated by arrow S in FIG. 5 serves to bring stop surface 141A into contact with portion 114' of pin 114, while simultaneously bringing stop surface 140B into contact with portion 114" of pin 114. Further rotation of handle 130 in the counterclockwise direction of arrow S causes the contacting surfaces of stops 140 and 141 to rotate pin 114 and hence rotate crankshaft 108 in a counterclockwise direction. Rotation of crankshaft 108 causes a reciprocal movement of connecting rod 70 which is attached thereto via knob 106.

Referring to FIGS. 1 and 2, counterclockwise rotation of disk-shaped arm 112 and attached knob 106 serves to move end 72 of connecting rod 70 away from abutment with interior wall 62A, as well as to reciprocate rod 70 away from cover 28 until knob 106 reaches an under center position wherein the spring forces generated by biasing members 86 and 92 take control of further rod and crankshaft movement. Continued rotation of arm 112 beyond the under center position in a counterclockwise direction is caused by these spring forces and serves to reciprocate connecting rod 70 toward cover 28, as well as moving rod end 72 into abutment with interior wall 62B as shown in FIG. 2. At the same time, cup-shaped retainer 90 moves away from contactor 66 allowing engagement spring 92 to expand to its free standing length. Further movement of connecting rod 70 toward cover 28 allows release spring 86 to snap contactor 66 toward cover 28 and out of electrical contact with conductive bodies 42—42. During upward, snap-action movement of rod 70, crankshaft pin 114 moves freely within the free space arc of about 45° to 60° between stops 140 and 141.

In order to initiate electrical contact between contactor 66 and conductive bodies 42—42, crankshaft 108 is rotated in the opposite or clockwise direction by handle 130. Such action brings stop surface 140A into contact with portion 114' and simultaneously brings stop surface 141B into contact with portion 114" of pin 114. As stops 140 and 141 force pin 114 and attached crankshaft 108 to rotate in a clockwise direction, rod 70 is drawn away from cover 28 and toward bottom wall 20 of switch housing 10. As a result, retainer 90 and engagement spring 92 causes contactor 66 to compress relatively soft release spring 86. After rod 70 passes through the under center position, continued clockwise rotation of disk-shaped arm 112 serves to again move rod 70 toward cover 28 until rod end 72 comes into abutment with interior wall 62A. At this point, contactor 66 forms an electrical connection with conductive bodies 42—42 and the contactor is held firmly in position by the spring force of engagement biasing spring 92 which greatly exceeds the spring force of release spring 86. The compressive movement and slight release of spring 92 after contactor 66 engages the upper surfaces of bodies 42—42 allows the under center movement of connection rod 70 as it moves toward abutment with wall 62A.

As shown in FIGS. 3 and 4, handle 130 includes a pair of bifurcated arms 142 and 144 extending radially outwardly from main shaft 110 of crankshaft 108. A conventional actuator cable assembly 150 includes an internal push-pull cable 151. Arms 142 and 144 are spaced from one another by a slot 149 of sufficient width to permit passage of an end portion 152 of push-pull cable 151 without binding. A cylindrical cable fastener 146 extends through and is pivotally supported within a pair of aligned openings 143—143 formed in arms 142 and 144, respectively. Cable fastener 146 includes a transverse aperture 147 for receiving cable end 152 and a longitudinal opening 148 extending outward from aperture 147. Cable end 152 is secured to cable fastener 146 for pivotal movement therewith by a fastening screw 153 threaded through opening 148 for a distance sufficient to engage and pinch a portion of cable end 152 against the opposite wall of aperture 147. While fastener 146 and cable end 152 are free to pivot within openings 143 and slot 149, respectively, fastener 146 is held in place within openings 143 by cable 151 which prevents significant longitudinal displacement of the fastener when these two components are fastened to each other by screw 153.

A cable support clip 160 includes a cylindrical end portion 161 having internal threads engaged by the spiral cable sheath 163 of cable assembly 150. A lock nut 159 also engages cable sheath 163 and abuts end 161 to lock the cable sheath in a fixed position relative to arms 142–144 and push-pull cable 151. Support clip 160 also includes a semi-circular pivotal mounting portion 162 connected to opposite end portion 161 by shank 165. Arcuate arms 163A and 163B of mounting 162 frictionally engage and partially surround a boss 164 extending from end wall 12. Because the inner radius of arcuate arms 163A and 163B is slightly less than the outer radius of boss 164, and because clip 160 is made of a flexible material, preferably plastic, mounting 162 expands so as to snap around and grip boss 164 with a frictional pressure sufficient to retain support clip 160 on boss 164, yet insufficient to prevent support clip 160 from pivoting about the longitudinal axis of boss 164 in the direction of arrow P as illustrated in dotted outline in FIG. 6.

During operation, cable 151 is pushed in the direction of arrow T to open the switch and is pulled in the direction of arrow Y to close the switch. Assuming the switch is in the closed position as shown in FIG. 1, and in the solid lines in FIG. 5, pushing a portion of cable 151 remotely located from switch 10 causes the entire cable 151 to move within its sheath 163. This movement causes cable end 152 and fastener 146 to pivot handle 130 in a counterclockwise direction toward the dotted line position shown in FIG. 5. As handle 130 pivots, stops 140 and 141 contact pin 114, causing pin 114 to also rotate in a counterclockwise direction as discussed above. As connecting rod 70 passes through it under center position, release spring 86 acts to snap contactor 66 out of engagement with conductive bodies 42—42. The snap-action movement of contactor 66 is possible because pin 114 can undergo free angular movement in the two spaces or gaps defined between opposing faces of stops 140 and 141. The movement of contactor 66 away from conductive bodies 42—42 may be limited by contact of connecting rod 70 with a side wall 62B of pocket 64 as shown in FIG. 2. Alternatively, movement of rod 70 may continue until spring 86 reaches a free standing position, provided chamber 60 is of sufficient depth. By careful positioning of connecting rod 70 within pocket 64, a swing through as little as 5° of arc is sufficient to move knob 106 and rod 70 from wall 62A to the under center position, with further movement of knob 106 initiating snap-action disengagement of the contactor assembly.

To return the switch to its closed position, it is merely necessary to pull cable 151 until stops 140 and 141 contact and rotate pin 114 in a clockwise direction, moving attached connecting rod 70 through bottom under center and into contact with side wall 62A of pocket 64. Spring 92 allows such under center movement while maintaining contactor 66 firmly pressed against the upper contact surfaces of conductive bodies 42—42.

Cable assembly 150 may be manually actuated by an operator remotely located from the switch assembly. Alternatively, cable 151 may carry the plunger portion of a solenoid so that the switch can be electrically operated from a remote location. The solenoid component can be either double acting so as to drive the cable in either direction, or single acting with the cable biased toward a position wherein the contactor is normally open and is driven closed by actuation of the solenoid coil. Such a single acting solenoid arrangement has the advantage of automatically turning off the switch to disconnect the battery when the vehicle power is off. A time delay mechanism, either vacuum or electrically powered, can also be utilized to turn off the switch after a preselected period of time has elapsed following vehicle shutdown.

INDUSTRIAL APPLICABILITY

Although the switch of the present invention is designed specifically for use as a battery disconnect switch in the direct current circuitry of an automobile, the switch has a wide variety of applications. Thus, it may be used on motorcycles, boats, airplanes, fork lifts, and off-road machinery; on stationery engine driven generators, pumps and the like; and on any other equipment requiring a battery for either starting or normal motive power.

The switch has particular utility in applications where the contacts must be sealed from the surrounding environment, such as a moisture laden or explosive gas atmosphere. In addition, the switch can be used in alternating current circuits at either 120, 240 or 480 voltage and with either two-phase or three-phase wiring. For three-phase application or where two storage batteries supply direct current to a circuit, a third insert is molded into the switch housing and the contactor plate has three depressed portions instead of two. Larger numbers of contacts are also possible with one contact leg for each conductive insert. Corresponding numbers of cable apertures are also provided, one for receiving each wire to be connected to a corresponding insert. As previously described, the switch is arranged to be readily mounted on any supporting surface to which a metal or plastic mounting bracket may be secured by mounting screws, or bolts, glue or the like. It can also utilize either new or existing wiring.

Although a remotely operated mechanical actuator means is described as a preferred embodiment, electrical actuator means responsive to a remotely operated switch are also contemplated by the invention. For example, push-pull cable 151 may be actuated by either a single or double acting solenoid as previously described. Alternatively, the connecting rod and crankshaft arrangement shown may be replaced by a single acting solenoid with a solenoid plunger connected to spring retainer 90 and arranged to reciprocate in an axial direction similar to connecting rod 70. In this alternative embodiment (not shown), the solenoid is energized so as to act against the forces of springs 86 and 92 and close contactor 66.

I claim:

1. A switch apparatus for selectively connecting a source of electrical power to an electrical system, said apparatus comprising:

a support;

at least two electrically conductive bodies mounted on said support in spaced relation to each other;

fastening means for connecting one of said conductive bodies to an electrical cable connected to said source of electrical power and the other of said conductive bodies to an electrical cable connected to said electrical system;

an electrically conductive contactor movable between a close position in contact with each of said at least two conductive bodies and an open position out of contact with each of said at least two conductive bodies;

connecting means for moving said contactor from said open position to said closed position and for releasing said contactor for snapping movement from said closed position to said open position, said connecting means having a first position corresponding to the closed position of said contactor, a second position corresponding to the open position of said contactor, and a release position between said first and second positions;

a first biasing mean for biasing said contactor toward its said open position; and, actuator means for moving said connecting means from said second position to said first position to close said contactor and from said first position to said release position to open said contactor, said connecting means being movable from said release position to said second position independently of further opening movement by said actuator means such that said first biasing means causes rapid movement of said connecting means relative to said actuator means and said contactor to snap from said closed position to said open position.

2. The switch apparatus of claim 1 which further includes a second biasing means cooperating with said connecting means and said contactor so as to press said contactor into engagement with said at least two conductive bodies in response to movement of said connecting means from said second position to said first position.

3. The switch apparatus of claim 2 in which said support comprises a housing having at least one chamber and said conductive bodies are mounted within said housing in communication with said chamber, in which said contactor is carried within said chamber, and in which said connecting means includes a connecting rod having means at one end for engaging said second biasing means and a base portion at the other end pivotally connected to a pivot means at a position spaced radially from the rotational axis of said pivot means, said pivot means having an undercenter release position for releasing said connecting rod so that said first biasing means causes said contactor to snap from said closed position to said open position when said actuator means moves said connecting means from said first position to said release position.

4. The switch apparatus of claim 3, wherein said first biasing means comprises a first spring member arranged to be compressed between a retaining member mounted on said connecting rod end portion and a surface of said contactor facing away from said conductive bodies, and wherein said first spring member presses said contactor into electrical contact with said at least two conductive bodies when said connecting rod is in a first position.

5. The switch apparatus of claim 4, wherein said second biasing means comprises a second spring member compressed between a supporting surface within said housing and a surface of said contactor confronting said conductive bodies, and wherein said second spring member holds said contactor out of electrical contact with said at least two conductive bodies when said connecting rod is in a second position.

6. The switch apparatus of claim 5 in which said spring members are coil springs and said first coil spring is relatively harder and of relatively shorter length than said second coil spring, and in which said coil springs cooperate with said connecting rod and said contactor so that said second coil spring snaps said contactor out of electrical engagement with said at least two conductive bodies in response to axial movement of said connecting rod in a direction away from said at least two conductive bodies.

7. The switch apparatus of claim 4, wherein said retaining member comprises a cup-shaped member having an aperture formed through a bottom wall to allow passage of a portion of said connecting rod therethrough.

8. The switch apparatus of claim 7, wherein said retaining member further comprises a pin extending outwardly from opposite sides of said connecting rod portion to prevent withdrawal of said connecting rod through said retaining member aperture.

9. The switch apparatus of claim 3, wherein said pivot means comprises a crankshaft assembly attached to the base portion of said connecting rod for movement therewith, wherein said crankshaft assembly includes a main shaft portion extending through an opening in said housing and a radial arm arranged for pivotal movement in a gap located between said conductive bodies, said radial arm including an eccentrically positioned knob extending through a bore in said base portion of said connecting rod so that pivotal movement of said radial arm causes reciprocation of said connecting rod along its longitudinal axis.

10. The switch apparatus of claim 9, wherein said actuator means further comprises a push-pull actuating cable attached to a handle located outside of said housing and extending radially outward from said main shaft, pivotal movement of said handle causing said connecting rod to move between a first and a second position.

11. The switch apparatus of claim 10 wherein said actuator means comprises a pin extending transversely and outwardly from a portion of said main shaft adjacent said handle, and wherein said handle includes at least one stop member arranged to engage said pin so that pivotal movement of said handle in one direction causes clockwise rotation of said crankshaft and movement of said contactor to its closed position and pivotal movement of said handle in another direction causes counterclockwise rotation of said crankshaft and release of said connecting rod such that said contactor snaps from its closed position to its open position.

12. The switch apparatus of claim 11, wherein said pin extends beyond opposite sides of said main shaft and a pair of arcuate stop members extend from said handle on opposite sides of said pin so as to engage said pin upon pivotal movement of said handle in either of said directions, and wherein said members are circumferentially spaced from one another to either side of an arc sufficient to allow said contactor to snap out of contact with said conductive bodies without said pin engaging either of said members until said contactor reaches its fully open position.

13. The switch apparatus of claim 12 in which the circumferential space between said stops is in the range of 45° to 60° of arc.

14. The switch apparatus of claim 3 in which said actuator means further comprises means for causing said contactor to engage said conductive bodies in response to a signal produced at a location remote from said housing.

* * * * *